United States Patent [19]

Agar

[11] Patent Number: 5,074,909

[45] Date of Patent: Dec. 24, 1991

[54] GOLD AND SILVER RECOVERY METHOD

[75] Inventor: Gordon E. Agar, Toronto, Canada

[73] Assignee: Inco Limited, Toronto, Canada

[21] Appl. No.: 614,084

[22] Filed: Nov. 15, 1990

[30] Foreign Application Priority Data

Dec. 4, 1989 [CA] Canada ..... 2004475

[51] Int. Cl.[5] ..... C22B 3/20

[52] U.S. Cl. ..... 75/422; 75/423; 423/29

[58] Field of Search ..... 75/422, 423, 735, 737, 75/741; 423/29, 30, 31

[56] References Cited

U.S. PATENT DOCUMENTS 2,187,750 1/1940 Marvin ..... 423/22

3,915,689 10/1975 Bartlett et al. ..... 75/327

4,802,916 2/1989 Victorovich et al. .

OTHER PUBLICATIONS

Chemical Abstracts No. 121061c, vol. 75, 1971, p. 191.

*Primary Examiner*—Melvyn J. Andrews

*Attorney, Agent, or Firm*—Francis J. Mulligan, Jr.; Edward A. Steen

[57] ABSTRACT

A process for recovering gold and silver from refractory ores containing precious metals locked in sulfide and arsenide minerals including roasting a concentrate of said sulfide and arsenide minerals with lime at a temperature of about 600° C. Thereafter the resultant calcine is ground, leached with cyanide and precious metals are recovered from the cyanide solution.

6 Claims, No Drawings

GOLD AND SILVER RECOVERY METHOD

The present invention is concerned with the recovery of gold and silver from ores deemed to be "refractory ores" and, more particularly, with the recovery of such precious metals using a cyanide leaching technique.

BACKGROUND OF THE INVENTION

In recovery of gold from gold ores by the cyanide extraction process, it is common for a portion of the gold to be associated with sulfide and arsenide mineral particles and thus not be available for dissolution in aqueous cyanide solution. At least as to sulfides, it has been known as early as the 1930's as evidenced by the practice of Lakeshore Mines Company in Canada, to separate sulfide mineral particles from the bulk of the gold ore by flotation. The sulfide mineral particles were then roasted to oxidize the mineral and break up the mineral crystal structure of the sulfide. The calcine resulting from roasting was then subjected to leaching in aqueous cyanide to recover gold. Generally a preponderant portion of gold and other cyanide leachable metals locked up in sulfidic and arsenide crystal structures can be recovered in this manner.

The roasting of sulfides and arsenides as previously practiced has certain difficulties. The roasting process produces sulfur dioxide and arsenic oxide as products which comprise or are entrained in flue gas. If flue gases containing these oxides are not treated to remove them prior to release to the atmosphere, a severe pollution problem exists. As a practical matter, such as operation releasing these oxides to the atmosphere could not likely obtain an operating permit in most localities. Pollution control apparatus for treating such flue gas to remove such oxides is expensive both with respect to initial capital outlet and operating costs. Further, one can expect a significant ongoing corrosion problem when treating such a flue gas.

OBJECT OF THE INVENTION

It is the object of the invention to provide an improved, environmentally advantageous process for recovering gold and other leachable metals from particulates of sulfide and arsenide minerals.

GENERAL STATEMENT OF THE INVENTION

The present invention contemplates a method for the recovery of metals such as gold and silver from minerals such as sulfides and arsenides which comprises roasting such minerals in the presence of lime to produce a calcine and thereafter subjecting the calcined product to a conventional leaching operation to recover the precious metals.

Lime should be present during the roasting operation in an amount at least about 75% of the stoichiometric amount necessary to produce $CaSO_4$ and $Ca_3(AsO_4)_2$ from the sulfur and arsenic present in the sulfide and arsenide minerals. More advantageously lime is present in the stoichiometric amount and still more advantageously is present in 15 to 25% excess over the stoichiometric amount. The lime can be present as hydrated or slaked lime $Ca(OH)_2$ or burnt lime (CaO).

Generally, in the ore being treated by the process of the present invention, only a portion of the contained gold or silver is locked in the crystal lattice of sulfide and arsenide minerals. As is usual in gold recovery, the ore is ground to a relatively fine particle size and either during grinding or thereafter (or both) the ore particles are exposed to an aqueous solution capable of leaching gold and silver. Ordinarily this solution contains a cyanide salt such as sodium or calcium cyanide. However, the present invention is not limited to the use of cyanide as a lixiviate for gold. As has been discussed in the art, aqueous solutions gold- and silver-dissolving substances such as alkali sulfides, alkali thiosulfates, chlorine, etc. can also be used. For all practical purposes, gold recovery is generally carried out using cyanides such as sodium cyanide, potassium cyanide, calcium cyanide in the form of dilute, oxygenated aqueous solutions. Assuming that aqueous cyanide is the gold-dissolving medium, ordinary practice involves exposure of the finely ground ore to aqueous cyanide and recovery of precious metal by a conventional process such as by the carbon-in-pulp (CIP) method or by displacement by zinc from aqueous cyanide solution separated from the ground ore solids. In any event, after solid liquid separation, washing of the solids and destruction of cyanide still associated with the leached ore solids, sulfides and arsenides in the leached ore solids are separated and recovered by conventional flotation techniques. Particulate form sulfide and arsenide minerals are then pelletized along with water and lime in an amount as disclosed hereinbefore on a conventional pelletizing apparatus such as a drum or disc pelletizer. The resulting lime-containing pellets are dried and then roasted at a temperature of about 500° to 700° C. Any conventional pellet roasting apparatus can be used for this purpose. Assuming at least a stoichiometric amount of lime is used, the roasted pellets will contain calcium arsenate in an amount essentially equivalent to the amount of arsenic in the flotation concentrate. The sulfur content of the roasted pellets will normally be at least about 90% of the sulfur content of the flotation concentrate. The remaining components of the roasted (calcined) pellets are essentially metal oxides, e.g. iron oxide together with precious metal in ultra-finely divided, readily leachable form. The calcined pellets are then ground and exposed to aqueous cyanide solution, perferably by being added to the ore stream entering the original grinding operation. Alternatively, the calcined pellets can be treated in a separate grind, leach, gold recovery operation, if desired.

It has been observed with a particular ore and a stoichiometric excess of hydrated lime that when roasting for four hours at 600° C., there was a greater degree of fixation of arsenic and sulfur when larger pellets were roasted as opposed to smaller pellets. Accordingly, it is deemed advantageous to maintain pellet size at an average of at least about 10 mm in diameter. In addition, roasting at relatively high temperatures, e.g. 700° C. and above, decreased arsenic fixation compared to roasting at lower temperatures, e.g. 600° C. Accordingly, it is deemed advantageous to roast at temperatures of about 550°-650° C., especially since it has been observed that fixation of arsenic as $Ca_3(AsO_4)_2$ is maximized by roasting at 600° C. When roasting at 600° C. using 8 mm average diameter pellets, roasting time can be as short as one hour.

PARTICULAR DESCRIPTION OF THE INVENTION AND EXAMPLES

The invention is now described in particular with respect to tests which were run on a flotation concentrate obtained from a gold ore originating in eastern Canada. The flotation concentrate was pelletized using 308.5 parts by weight of $Ca(OH)_2$ to 500 parts by weight of concentrate which were mixed and pelletized on a 35.6 cm disc by spraying with water to give about 16% by weight moisture. Pellets were dried at 100° C. About 97% of the pellets were larger than 4.75 mm and smaller than 9.5 mm in diameter. Roasting was done in a muffle furnace for four hours after a heat-up of one hour from 100° C. except for Example 4 where, after heat-up the furnace was held at 500° C. for two hours, heated to 600° C. over one-half hour and held at 600° C. for two hours. After roasting the calcined pellets were ground and leached with sodium cyanide solution and gold was recovered from the solution. Results obtained on ground calcine in terms of calcine composition and percent of gold leached from the calcine are set forth in Table I.

TABLE I

| Test | Roast Temp. (°C.) | Concentrate Feed Analysis: 11.0 ppm Au, and %: 0.14 Cu, 0.05 Ni, 21.4 Fe, 18.2 TS, 9.46 As, and 1.85 $C_G$ | | | | | | % Au Extn by CIL |
|---|---|---|---|---|---|---|---|---|
| | | Calcine Assay, % | | | % Retained in Calcine | | | |
| | | TS* | $SO_4$ | As | TS | As | % S as $SO_4$ | |
| Ex. 1 | 500 | 8.58 | 16.0 | 4.50 | 79.3 | 80.0 | 62.2 | 71.9 |
| Ex. 2 | 600 | 8.53 | 21.7 | 5.26 | 79.2 | 93.9 | 84.8 | 82.8 |
| Ex. 3 | 700 | 9.09 | 25.7 | 4.11 | 83.9 | 73.0 | 94.2 | 80.3 |
| Ex. 4 | 500/600 | 8.64 | 21.1 | 5.20 | 80.2 | 92.2 | 81.4 | 73.2 |

*TS is Total Sulfur

The same concentrate feed in the form of slightly larger pellets containing 15% excess lime over the stoichiometric amount needed to combine with sulfur and arsenic was used in roasting tests at 600° C. to determined the effect of roasting time. Results parallel to those of Table I are set forth in Table II.

TABLE II

| Test | Roast Time at 600° C.,h | Calcine Assay, % | | | | % Retained in Calcine | | % S as $SO_4$ | % Au EXTN by CIL |
|---|---|---|---|---|---|---|---|---|---|
| | | TS | $SO_4$ | As | $C_G$* | TS | As | | |
| Ex. 5 | 1 | 9.65 | 22.5 | 5.60 | 0.08 | 93.7 | 99 | 77.7 | 81.6 |
| Ex. 6 | 2 | 9.58 | 23.2 | 5.40 | 0.05 | 93.1 | 99 | 80.7 | 83.1 |
| Ex. 7 | 4 | 9.58 | 23.4 | 5.40 | 0.05 | 93.2 | 99 | 81.4 | 81.4 |
| Ex. 8 | 6 | 9.63 | 23.4 | 5.60 | 0.04 | 93.3 | 99 | 81.0 | 84.1 |

*$C_G$ = Graphitic Carbon

A comparison of the results set forth in Tables I and II, especially comparing Example 2 with Examples 5–8 confirms that 600° C. is an effective roasting temperature and that satisfactory results are achieved in about one hour roasting time. Comparison also shows that with pellets larger than those used in Example 2 (i.e. pellets having a size distribution of 80% between 9.5 and 4.75 mm diameter and 20% between 12.7 and 9.5 mm) essentially all of the arsenic in the feed reports to the calcined pellets. A comparative test with pellets intermediate in size between those of Example 2 and those of Examples 5–8 showed intermediate results in retention of sulfur and arsenic after roasting. Gold extraction after grinding the calcined pellets is not affected adversely by varying pellet size within the range explored in the examples.

Tests on the same concentrate pelletized with varying amounts of lime from 73.3 to 137.4% stoichiometric, dried, roasted for four hours at 600° C. showed an increase in total sulfur retained in the calcine from about 56 to 97% with increasing lime. A parallel increase in arsenic retained in the calcine ranged from 89 to 98% with increasing lime. Gold extraction from calcined and ground pellets increased slightly with increasing lime from 81 to 84%.

Additional test involving substitution in whole or in part of limestone ($CaCO_3$) for lime in the process of the present invention indicates that there is no advantage in making such a substitution. Total sulfur retained in pellets calcined for four hours at 600° C. decreases with increasing limestone. As to retaining arsenic in the calcined pellets, a small degree of substitution, e.g. up to 25% may be tolerable, but arsenic retention rapidly decreases as higher amounts of limestone are used. Use of limestones does not appear to be beneficial to gold recovery. Further tests involving use of limestone and roasting at temperatures up to 800° C. did not have a beneficial effect on the amount of sulfur retained in the calcined pellets. Using a standard concentrate-lime-limestone mixture, the percentage of total sulfur retained in the calcined pellets decreased from about 50% to 43% with increasing temperature from 600° C. to 800° C.

Tests on two other concentrates pelletized as previously described and roasted for four hours at 600° C. were made. About 70% of pellets of Concentrate 2 had diameters between 9.5 and 4.75 mm with the remainder having diameters between 9.5 and 12.5 mm. The comparable percentages for pellets of Concentrate 3 were 70% and 22% respectively. Results of the tests on concentrates 2 and 3 are set forth in Table III.

TABLE III

| Analyses (ppm Au or %) | Au | Cu | Ni | Fe | As | TS | $C_G$ |
|---|---|---|---|---|---|---|---|
| Concentrate 2 | 18.5 | 0.59 | 0.061 | 26.8 | 13.0 | 22.7 | 0.67 |
| Concentrate 3 | 24.0 | 0.17 | 0.11 | 32.2 | 7.41 | 30.0 | 0.045 |

| Test | Conc. | Reagent Addn $Ca(OH)_2$ (g/100 g Conc.) | Calcine Assay, % | | | | % Retained in Calcine | | % S as $SO_4$ | % Au EXTN by CIL |
|---|---|---|---|---|---|---|---|---|---|---|
| | | | TS | $SO_4$ | As | $C_G$ | TS | As | | |

TABLE III-continued

| | | | | | | | | | | |
|---|---|---|---|---|---|---|---|---|---|---|
| Ex. 9 | Con. 2 | 81.6 | 9.35 | 24.8 | 6.25 | 0.08 | 77.8 | 90.7 | 88.6 | 79.8 |
| Ex. 10 | Con. 3 | 95.4 | 12.8 | 30.7 | 3.43 | 0.04 | 90.8 | 98.5 | 80.1 | 83.8 |

Table III shows that the present invention is applicable to varying arsenic-sulfur-containing concentrates and that, after roasting, gold can be recovered efficiently from the resultant calcine by dissolution in aqueous cyanide.

As those skilled in the art may be aware, in order to float concentrates from a cyanide leach residue, it may be necessary or desirable to destroy cyanide associated with such residue. One efficient means of accomplishing this is to employ the process of Canadian Patent No. 1,165,474. Alternatively, cyanide can be destroyed and arsenic in solution can be precipitated using the process described in Canadian Patent No. 1,241,774. As another point, those skilled in the art should be aware that in cyanide leaching of calcines as produced in the process of the present invention, it may be necessary to adjust the pH of the cyanide solution to maximize gold dissolution.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiment of the invention in which an exclusive property or privilege is claimed are defined as follows.

1. An environmentally advantageous process for recovery of metal from the group of gold and silver from minerals from the group of sulfides and arsenides comprising roasting said minerals at a temperature in the range of about 500 ° to 700° C. in the presence of lime in a quantity sufficient to react with at least about 75% of the sulfur and arsenic present in said minerals to form calcium sulfate and calcium arsenate and thereafter subjecting the calcined product of said roasting operation to an extraction and recovery operation for said gold and silver.

2. A process as in claim 1 in which lime is present in an amount of least stoichiometrically equivalent to the amount of sulfur and arsenic in said sulfide and arsenide minerals to produce calcium sulfate and calcium arsenate.

3. A process as in claim 2 in which lime is present in an amount of excess of that amount stoichiometrically equivalent to the amount of sulfur and arsenic in said sulfide and arsenide minerals.

4. A process as in claim 2 wherein said sulfide and arsenide minerals are in particulate form in a flotation concentrate from a gold ore and said particulates are pelletized along with lime prior to roasting.

5. A process as in claim 4 wherein roasting is carried out at about 550° to 650° C.

6. A process as in claim 1 wherein during said extraction gold and silver are leached from the product of the roasting operation by aqueous cyanide solution and thereafter recovered from said aqueous cyanide solution.

* * * * *